United States Patent [19]

Lim et al.

[11] Patent Number: 4,744,305

[45] Date of Patent: May 17, 1988

[54] EXHAUST REMOVAL SYSTEM

[75] Inventors: Edward Lim, Coquitlam; Gary Pattullo, Squamish; Wayne Maksylewich, North Vancouver; Robert Woolley, Prince George; John Lusney, West Vancouver, all of Canada

[73] Assignee: B.C. Rail, Vancouver, Canada

[21] Appl. No.: 924,350

[22] Filed: Oct. 29, 1986

Related U.S. Application Data

[63] Continuation-in-part of Ser. No. 854,165, Apr. 21, 1986, abandoned.

[51] Int. Cl.[4] ..... B08B 15/02

[52] U.S. Cl. ..... 104/52; 98/49; 98/115.1

[58] Field of Search ..... 98/49, 115.1; 104/51, 104/52, 138.1, 146; 110/159

[56] References Cited

U.S. PATENT DOCUMENTS 957,396 5/1910 Weomark ..... 98/49
1,028,437 6/1912 Clasen ..... 104/52
2,942,540 6/1960 Lundy ..... 98/115.1

FOREIGN PATENT DOCUMENTS 360246 9/1922 Fed. Rep. of Germany ..... 104/52
430593 7/1926 Fed. Rep. of Germany ..... 98/49
2504189 8/1976 Fed. Rep. of Germany ..... 98/49
3117147 11/1982 Fed. Rep. of Germany ..... 98/49
6163 12/1882 United Kingdom ..... 98/49

*Primary Examiner*—Harold Joyce
*Attorney, Agent, or Firm*—Christie, Parker & Hale

[57] ABSTRACT

A diesel exhaust hood system is disclosed in which a narrow smoke entry slot and large capacity allow bursts of exhaust gases from locomotive engines to be contained inside the hood. The likelihood of spillover from exhaust exceeding the fan capacity is reduced by the use of the inverted V-shape design of the smoke entry slot. A plurality of damping baffles positioned along the length of the hood can be adjusted independently to retain a constant slot velocity throughout the length of the hood.

9 Claims, 2 Drawing Sheets

EXHAUST REMOVAL SYSTEM

CROSS REFERENCE TO RELATED APPLICATION

This application is a continuation-in-part to application Ser. No. 854,165, filed Apr. 21, 1986, now abandoned.

FIELD OF THE INVENTION

This invention relates to diesel exhaust hood systems and more particularly to a hood designed for ventilating diesel locomotive engines in service facilities.

DESCRIPTION OF THE PRIOR ART

Ventilation of diesel locomotive exhaust fumes inside a service bay has been problematic for a long time. A standard locomotive engine at idle speed can discharge 1.84 cubic meter of exhaust per second and at full throttle such as when the diesel engine is started, a diesel locomotive engine can discharge up to 10.4 cubic meters of exhaust per second. In prior art open hood design, the discharge volume of exhaust gases from the engine would at times exceed the fan and hood capacity promoting the formation of circulation cells in the hood resulting in a spillover of exhaust gases. This condition not only creates an unclean work environment but also can represent a health hazard for employees working in the service facilities.

A number of studies have shown that the prediction of hood performance was based upon hood geometry and environment, hood suction, fume flow rate at the hood and cross draft. It has also been found that cross drafts have harmful effects on hood performance. It has been found that the capture velocity of exhaust hoods were influenced by hood size and face velocity.

Accordingly, there existed a requirement for an exhaust hood design which permitted the minimization of exhaust volumes to reduce make up air requirements, a hood design having the capacity to contain rapid surges in exhaust volumes, a design which minimize the effects of cross drafts as well as having minimal restrictions on locomotive positioning.

Solutions, such as movable hoods which are positioned over the exhaust port on the engine, can be effective but the engine must be pushed into the service bay rather than driven and large movable snorkels are required. This type of hood has proven to be inconvenient and a maintenance problem. Prior art exhaust systems such as disclosed in U.S. patents having Ser. Nos. 920,041; 1,337,374; 1,499,512; 2,665,647; 3,492,937 all have a number of drawbacks which make them unsuitable and impractical for use with today's high power locomotive diesel engines. Their designs promotes the swirling of gases inside the hood which results in the spillover of fumes especially when a sudden burst of exhaust fumes occurs.

German Pat. No. 430,593 describes a gravity vented canopy hood which has been found to be greatly affected by cross draft as well as being known to cause spillage of fume from the hood. In addition, a gravity hood of this type has no capture velocity but relies on either a thermal head or inertial force for exhaust capture. Exterior wind forces can produce back drafting through the hood.

U.S. Pat. No. 2,942,540 which issued to Lunde has been designed and is intended to produce separation of a gas stream into two or more component streams. The vanes or slots are in a fixed position and obviously intended as flow straighteners and to prevent mixing. No provision is made for surge capacity, cross drafts or spillage control. The design by Lunde would not function acceptably as a fume hood.

SUMMARY OF THE INVENTION

It is therefore an object of the present invention to provide a locomotive exhaust hood system which will capture and contain surges of exhaust gases when the volume of exhaust gases temporarily exceeds the fan capacity.

A second object of the present invention is to provide a locomotive exhaust hood system having an adjustable slot width to accommodate changes in the distance between the source and the hood.

A third object of the present invention is to provide a locomotive exaust hood system which maintains a constant air flow along the length of the hood.

A fourth object of the present invention is to provide a locomotive exhaust hood system which will prevent spillover of exhaust gases due to the formation of circulation cells within the hood.

A fifth object of the present invention is to provide a locomotive hood system which minimize the number and size of exhaust fans as well as reduce the amount of clean air captured along with the locomotive fumes.

A sixth object of the present invention is to provide a method of venting a locomotive service facility.

These and other objects have been accomplished by providing a hood design which has separate independent compartments to minimize exhaust volumes and allow free positioning of locomotives, a slot to distribute the inlet velocity more evenly along the hood length, a variable slot to allow adjusting of the slot velocity for various hood-to-locomotive separations, a V-shaped entrance to maximize surge capacity at the entrance, minimize spillage and minimize the effect of cross drafts, and a large hood to provide internal fume storage for surge conditions while allowing use of a relatively small fan.

According to one aspect of the present invention there is provided an exhaust system for use in locomotive service facilities comprising an exhaust system for use in locomotive service facilities, comprising: a hood extending a substantial distance inside said service facilities over a track, said hood having an elongated opening adapted to be positioned over the exhaust port of a locomotive and having a number of hood sections, each separated from another by a baffle and each having at least one exhaust fan; a plurality of independently adjustable damping baffles positioned along the length of each hood section, said baffles extending upwardly and inwardly to form a generally inverted V-shaped smoke entry slot of variable width.

According to a second aspect of the present invention there is provided a method of venting a locomotive service facility having a hood extending over a track, a substantial distance inside the service facility, said hood having an elongated opening adapted to be positioned over the exhaust port of a locomotive and having a number of hood sections each separated from another by a baffle and each having at least one exhaust fan and a plurality of independently adjustable damping baffles positioned along the length of each hood section, comprising the steps of: detecting the presence of a locomotive exhaust port below a first hood section; activating the exhaust fans of said first hood section as the locomotive is driven under said hood section; adjusting the damping baffles of the first hood section to maintain a constant slot velocity along the length of said opening; detecting the presence of the locomotive exhaust port below a second hood section; activating the exhaust fans of said second hood section; adjusting the damping baffles of the second hood section to maintain a constant slot velocity along the length of said opening; and deactivating the exhaust fans of the first hood section.

DRAWINGS

Particular embodiments of the invention will be understood in conjunction with the accompanying drawings in which.

Figure 4:
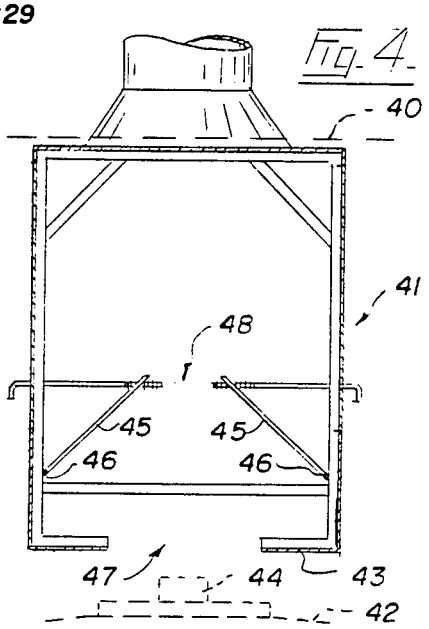
Figure 5:
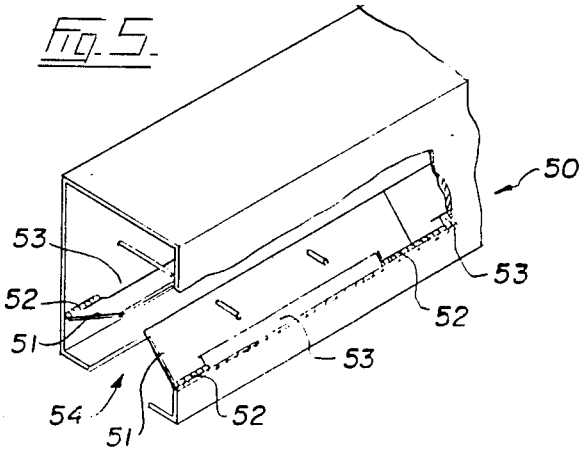

FIG. 4. is a sectional view of an exhaust hood according to another embodiment of the present invention; and FIG. 5 is a partially sectioned perspective view of the exhaust hood according to yet another embodiment of the present invention.

DESCRIPTION OF THE PREFERRED EMBODIMENTS

Figure 1:
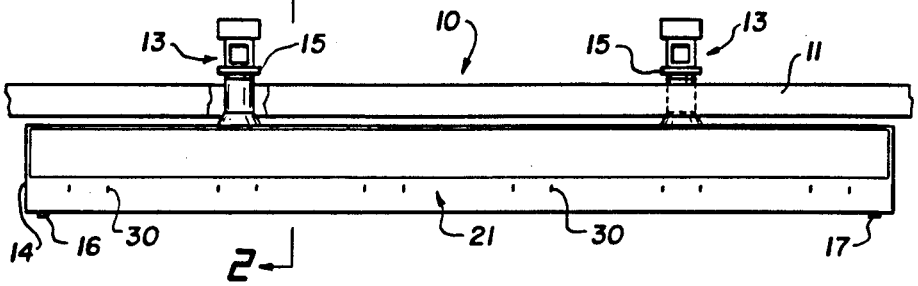
FIG. 1 is a side view of the exhaust hood system disclosed in the present invention.

Referring now to FIG. 1, we have shown at reference numeral 10 a diesel exhaust hood system which is suspended from a roof joist 11 of a typical service facility. The exhaust hood system is comprised of an elongated hood 21 and exhaust fan 13. Hood 21 is suspended from roof joist 11. The exhaust system shown in FIG. 1 typically represent one hood section which can be provided with two exhaust fans 13. In a typical service facility, a number of these hood sections 21 can be provided along the length of the service facility such that a locomotive engine can be driven into a service bay under the exhaust hood. In a typical locomotive servicing facility, each hood section would, for example, be approximately 24 meters in length and would be provided with two exhaust fans per hood section each having a fan capacity of 11.32 cubic meters per second. It will be understood by those knowledgeable in this art that the size of hood section and exhaust fan capacity may be varied to accommodate a specific requirement. Each section of hood is separated from an adjoining section by a baffle or end wall 14 so that one section can be operated independently of others in order to reduce the amount of energy required to operate the exhaust fans and to reduce the volume of make-up air requirements. For example, in a service facility having three of those hood sections, laid out along the length of the service facility, as a locomotive is driven into the service facility, a first exhaust hood section would be activated without requiring activation of the other two hood sections thereby saving energy.

Once the locomotive has passed a first hood section, the second hood section could then be activated to ensure proper ventilation and exhaust of the diesel fumes. The exhaust fans of the first hood section would be deactivated by, for example, time delay control 15 to ensure all exhaust fumes remaining in the first hood section are removed therefrom.

The exhaust fans 13 for the system are roof mounted vertical discharge fans. The exhaust hood is suspended from roof trusses 11. The exhaust hood 21 can be constructed of 24 gauge galvanized steel sheet metal attached to an angle iron frame. The metal panels can be beaded for extra rigidity. The frames are designed to provide structural strength sufficient to allow service access within the hood.

Figure 2:
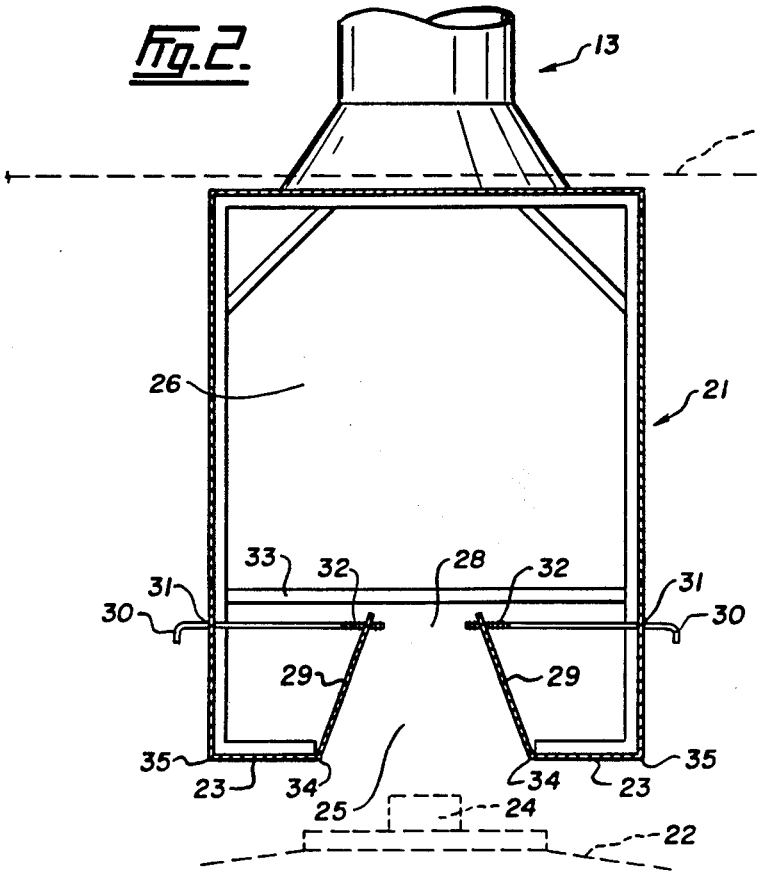
FIG. 2 is a sectional view taken along lines 2—2 shown in FIG. 1.

FIG. 2 is a sectional view of the diesel exhaust hood taken along the lines 2—2 of FIG. 1. The roof of the service facility is depicted by broken line 20. Hood 21 is placed relatively close to the top of the engine, depicted by broken line 22, so that the gap between the bottom of the hood 23 and the locomotive exhaust port can be relatively small, say, approximately 10 cm. This relatively small gap allows complete capture of the exhaust at relatively low slot velocities when the locomotive 22 is under hood 21.

On the other hand, if the locomotive exhaust port 24 is positioned well below the bottom 23 of hood 21, as will be described below, the slot velocity can be increased to also permit complete capture of the exhaust fumes. The cross-sectional shape of the hood design is retained throughout the length of the hood in order to achieve proper clearance of miscellaneous objects such as locomotive horns, bells, etc. when the locomotive is advanced under the hood.

Another important feature of this hood design .irs the use of a narrow smoke entry slot 25 and a large internal capacity 26 which can allow surges of exhaust gases from the engines to be contained inside hood 21. A surge of exhaust gas can enter the hood and expand down the full length of the hood 21. The slot velocity along entrance 28, is sufficient to prevent escape of fumes. The storage volume reduces the likelihood of any spillover from the exhaust into the room when a possible spillover condition exists. A spillover condition exists when the amount of exhaust fumes leaving the exhaust port 24 and entering the hood 21 exceeds the exhaust removal capacity of fan 13 and/or the storage capacity of the exhaust hood 21.

Hood 21 is designed with adjustable slot dampers or damping baffles 29 which can be used to control and maintain a constant slot velocity at entrance 28 and over the full length of a hood section. By this novel exhaust system design, a single hood section would, for example, be provided with a number of adjustable damping baffles 29 which could either be manually or automatically adjusted by means of rods 30 rotatably secured at end 31 and connected to dampers 29 at threaded ends 32. This important design feature of the exhaust hood system prevents the existence of an uneven slot velocity along an entire hood section which would be created by the location of the high capacity exhaust fans 13. That is, if slot dampers were either not adjustable or not provided, a high negative pressure area and high slot velocity would exist in close proximity of the exhaust fans whereas a relatively low negative pressure area and low slot velocity would exist away from the exhaust fans thus creating uneven air flow along the length of a hood section. This unwanted condition could result in the loss of exhaust fumes in the low negative pressure areas during normal operating conditions and especially when a burst of exhaust fumes occurred.

The use of individually adjustable damping baffles 29 not only compensates for the positioning of the exhaust fans 13 but also minimizes the number and size of exhaust fans as well as reduces the amount of clean air captured along with the locomotive exhaust fans.

The inverted V-shape design of the hood entry slot 25 inhibits smoke losses which would ordinarily result from cross drafts and the swirling of exhaust gases within entry slot 25. Angle framing 33 suitable for support of temporary planking is provided to allow service access within the hood.

Damping baffles 29 are suitably hinged along the longitudinal edge at 34 permitting easy size adjustment of the opening size of entrance 28 and thus the slot velocity. Damping baffles 29 can also be hinged directly at bottom corners 35 of hood 21, thereby eliminating the need of bottom supports 23.

An exhaust hood having a cross-sectional area of 2.3 meters by 1.8 meters, gives a cross-sectional area of slightly over 4 square meters. Therefore, a hood 24 meters in length would provide a volume capacity of the order of 100 cubic meters. A slot size of 450 millimeters can for example provide a slot velocity of 2.1 meters per second. This number is of course dependent on the volume of the hood 21 and capacity of exhaust fan 13.

The exhaust system can be controlled either manually or automatically through the use of photoelectric sensors 16 and 17 positioned under the hood sections and which would activate the exhaust fans and activate the time delay 15, respectively, when a diesel locomotive is driven under the exhaust hood. These controls can be arranged so that the hood sections would start in an overlapping fashion as a diesel locomotive is moved down the length of the track in the service facility.

Figure 3:
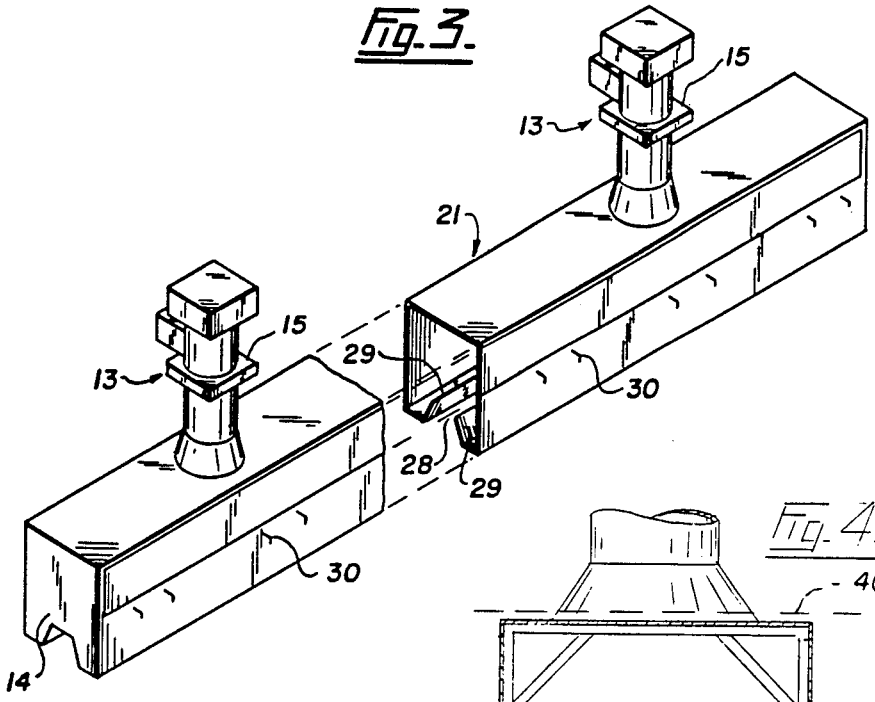
FIG. 3 is an isometric view of the exhaust hood system disclosed in the present invention.

FIG. 3 is a perspective view of the diesel exhaust hood system disclosed in the present invention. Exhaust fans 13 can have axially mounted fan blades and can be made of heavy welded steel casings of the extruded type, galvanized after manufacture with flange ends for duct mounting. The fan casings incorporate welded motor supports, hinged or bolted access plates, adequate for servicing of all internal parts. The fans can use aerofoil impellers of the non-overloading type with totally enclosed motors in weatherproof housing the actual physical configuration of the axial fans need not be described further since those are well known by those knowledgeable in this art. Adjusting rods 30 are positioned along the entire length of the hood 21 to permit the adjustment of individual damping baffles 29 and ideal operating position and so that the slot velocity can be varied to suit local operating conditions by changing the size of the entrance 28 of entry slot 25.

The size and volume of the smoke entry slot 25 shown in FIG. 2 is adjusted by raising or lowering damping baffles 29.

Referring now to FIG. 4 we have shown a cross section of a hood designed according to a second embodiment of the present invention. Similarly, this hood is suspended from a roof of a locomotive service facility which is depicted by broken line 40. Hood 41 is positioned above the top of a locomotive engine depicted by broken line 42 and close enough such that the gap between the bottom of the hood 43 and the locomotive exhaust port 44 is relatively small.

In this embodiment, the adjustable slot dampers 45 have been moved inside the hood with hinge connections 46 secured to the interior panel of hood 41. By positioning the slot dampers 45 inside hood 41, the bottom opening 47 can be made the full width of hood 41. This provides greater flexibility when cross drafts are encountered or when the separation between bottom 43 of hood 41 and the exhaust port 44 is increased. The larger volume between the opening 47 and the slot 48 provides more surge capacity.

Yet another embodiment of the hood design of the present invention is shown in FIG. 5. Exhaust hood 50 is similarly provided with adjustable dampers 51 hingedly mounted at 52 by a pair of hinges to the interior wall of hood 50. However, in this embodiment, additional slots 53 have been provided between the hinged connections of adjustable slot dampers 51. The provision of additional slots partially extending at the base and along the longitudinal length of dampers 51 allow for a better capture of fume swirling within the storage area. These additional slots provide a certain amount of additional slot velocity and therefore will enhance the exhaust of fumes which are swirling within the surge chamber 54.

In a typical locomotive service facility, air supply make-up units would also be installed in order to provide make-up air equal in volume to the amount of air removed via the exhaust control facility. Failure to supply adequate make-up air would result in a negative pressure inside the building and reduce the performance of the exhaust system fans.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

We claim:

1. An exhaust system for use in locomotive service facilities, comprising:

a hood extending a substantial distance inside said service facilities over a track, said hood having an elongated opening adapted to be positioned over the exhaust port of a locomotive and having a number of hood sections, each separated from another by a baffle and each having at least one exhaust fan; and a plurality of independently adjustable damping baffles hingedly mounted along the longitudinal edge of said hood opening, said baffles extending upwardly and inwardly to form a generally inverted V-shaped smoke entry slot of variable width.

2. An exhaust system as defined in claim 1 wherein said hood section further includes sensing means to activate said exhaust fan when a locomotive is detected below said hood sections.

3. An exhaust system as defined in claim 2 wherein said exhaust fans further include time delay means for deactivating said fans once the locomotive has moved under an adjacent hood section.

4. An exhaust system as defined in claim 3 wherein said sensing means comprises photoelectric sensors.

5. An exhaust system as defined in claim 1 wherein said damping baffles are hingedly mounted to side walls of said hood sections above said opening.

6. An exhaust system as defined in claim 5 wherein said damping baffles further include a slot opening extending partially along the length of said baffles.

7. An exhaust system as defined in claim 6 wherein said slot opening is formed along the mounted edge of said damping baffle between a first and second support hinge.

8. A method of venting a locomotive service facility having a hood extending over a track, a substantial distance inside the service facility, said hood having an elongated opening adapted to be positioned over the exhaust port of a locomotive and having a number of hood sections each separated from another by a baffle and each having at least one exhaust fan and a plurality of independently adjustable damping baffles positioned along the length of each hood section, comprising the steps of:

detecting the presence of a locomotive exhaust port below a first hood section;

activating the exhaust fans of said first hood section as the locomotive is driven under said hood section;

adjusting the damping baffles of the first hood section to maintain a constant slot velocity along the length of said opening;

detecting the presence of the locomotive exhaust port below a second hood section;

activating the exhaust fans of said second hood section;

adjusting the damping baffles of the second hood section to maintain a constant slot velocity along the length of said opening; and deactivating the exhaust fans of the first hood section.

9. A method as defined in claim 8 wherein said first hood section is deactivated after a time delay.

* * * * *